US006520124B2

(12) United States Patent
Bohm, II

(10) Patent No.: US 6,520,124 B2
(45) Date of Patent: Feb. 18, 2003

(54) DOUBLE WALLED FUEL TANK WITH INTEGRAL GENERATOR SET MOUNTING FRAME

(75) Inventor: John A. Bohm, II, Milwaukee, WI (US)

(73) Assignee: Tramont Corporation, Milwaukee, WI (US)

( * ) Notice: Subject to any disclaimer, the term of this patent is extended or adjusted under 35 U.S.C. 154(b) by 0 days.

(21) Appl. No.: 09/736,491

(22) Filed: Dec. 13, 2000

(65) Prior Publication Data

US 2002/0069840 A1 Jun. 13, 2002

(51) Int. Cl.[7] ..... F02B 63/00

(52) U.S. Cl. ..... 123/2; 248/678; 290/1 A; 220/4.12

(58) Field of Search ..... 123/2; 290/1 A; 248/678; 220/4.12

(56) References Cited

U.S. PATENT DOCUMENTS

| | | | | |
|---|---|---|---|---|
| 2,677,353 A | | 5/1954 | Sharp | |
| 2,687,624 A | | 8/1954 | Campbell | |
| 3,848,765 A | | 11/1974 | Dürkop | 220/9 |
| 4,136,432 A | | 1/1979 | Melley, Jr. | 29/469 |
| 4,191,356 A | | 3/1980 | Ashmun et al. | 248/678 |
| 4,556,247 A | | 12/1985 | Mahaffey | 296/24 |
| 4,640,439 A | | 2/1987 | Palazzo | 220/445 |
| 5,031,690 A | | 7/1991 | Anderson et al. | 165/43 |
| 5,090,586 A | | 2/1992 | Mitchell | 220/453 |
| 5,494,183 A | | 2/1996 | Sharp | 220/469 |
| 5,590,806 A | | 1/1997 | Green et al. | 220/562 |
| 5,620,111 A | * | 4/1997 | Gehman | 220/571 |
| 5,642,702 A | | 7/1997 | Kouchi et al. | 123/198 |
| 5,678,512 A | | 10/1997 | Colton | 123/2 |
| 5,744,940 A | | 4/1998 | Colton et al. | 322/1 |
| 5,762,232 A | | 6/1998 | Green et al. | 220/564 |
| 5,804,946 A | | 9/1998 | Gaubatz et al. | 322/1 |
| 5,829,625 A | | 11/1998 | Imagawa | 220/567.1 |

FOREIGN PATENT DOCUMENTS

| | | |
|---|---|---|
| GB | 2323973 A | 10/1998 |
| JP | 5234774 | 9/1993 |

OTHER PUBLICATIONS

F.G. Wilson (Engineering) Ltd., *4 Cycle Top Diked Tankbase Assembly*, Drawing Nos.: MBA0706; MBS0346; MBS0347; MBS0349; MTA0531; MBS0348; MBC3098; MBC0427; MBC0218; MBC3097; and MTC0541.

F.G. Wilson (Engineering) Ltd., *B2 24 Hour Closed Top Diked Tankbase Assy.*, Drawing Nos.: MBA0943; MBS0436; MBC3771; MBC3574; MBC3575; MBS0435; MBC3576; MBS0442; MBC3774; MBC3773; MBC3775; MBC3782; MBC3780; MBC3776; MBC3777; MBC3778; MBC3779; MBC3783; MBC3784; MBC3785; MBC3786; MBC3787; MBC3788; MBS0438.

* cited by examiner

*Primary Examiner*—Noah P. Kamen
(74) *Attorney, Agent, or Firm*—Boyle Fredrickson Newholm Stein & Gratz S.C.

(57) ABSTRACT

The present invention is a double-walled tank for a generator set including an integral mounting assembly. The tank is formed of an outer basin having an open top, a bottom wall and a number of side walls that define an interior within the basin and form the exterior of the tank. An enclosed inner member having a top panel, a bottom panel and a number of side walls connecting the top and bottom panels is attached within the interior of the basin and provides a double-walled construction that serves to retain fuel within the tank when the external walls of the tank are damaged. An integral mounting assembly is attached to and extends across the basin over the inner member between the side walls of the basin and is configured to receive and support a generator, engine, and radiator to form a complete generator set.

25 Claims, 3 Drawing Sheets

DOUBLE WALLED FUEL TANK WITH INTEGRAL GENERATOR SET MOUNTING FRAME

FIELD OF THE INVENTION

The present invention is directed to generator sets and more specifically to a fuel tank in a generator set that functions as a support for the other components of the generator set and also holds an amount of fuel to be utilized by the generator set.

BACKGROUND OF THE INVENTION

Generator sets are often used to provide a source of either primary or supplemental electrical power at locations where more conventional sources of this type of power are limited or not available. A generator set generally includes an internal combustion engine that is connected to an electrical generator which supplies power to the generator. The engine is connected opposite the generator to a radiator that is used to cool the engine while it is in operation.

All of the above components of the generator set assembly are supported by a tank to which the engine, generator and radiator are mounted. The tank is generally a large enclosure having a capacity of hundreds of gallons in order to allow the generator set to operate continuously for an extended period of time.

The tank is formed as a generally rectangular single-wall enclosure having a top wall to which the remaining components of the generator set are mounted, a bottom wall opposite the top wall and a series of side walls joining the top and bottom walls and enclosing the tank. The top wall includes a number of openings, some of which receive conduits that allow fuel to be supplied to and from the tank. The tank may be constructed to include a releasable frame assembly that is securable to the top wall and on which the engine, generator and radiator are mounted in order to attach these components to the tank. As an alternative to the frame assembly, the tank may include an integral mounting arrangement that is fixedly attached to the side walls of the tank and extends across the top wall of the tank. The mounting arrangement receives the portions on each generator set component that are used to secure the components to the tank.

However, due to the increased attention given to environmental concerns, particularly with respect to those industries utilizing highly hazardous materials such as the heavy hydrocarbon fuels utilized with generator sets, the single-walled construction of most generator set tanks is not adequate to ensure that the fuels contained within these tanks will not leak excessively and cause serious environmental damage if the exterior of the tank is damaged.

Therefore, it is desirable to develop a generator set tank that includes a double-walled construction that minimizes and/or eliminates any leakage of fuel from the tank due to damage caused to the exterior of the tank. The generator set tank should also include an integral mounting arrangement such that once the construction of the tank is completed, the respective components of the generator set may be mounted directly to the tank and the generator set can be immediately transported in its entirety and placed into service.

SUMMARY OF THE INVENTION

It is an object of the present invention to provide a generator set tank that includes a double-walled construction capable of minimizing or eliminating any leakage of fuel from the tank in response to damage done to the outer chamber or wall of the tank.

It is another object of the invention to provide a generator set tank having a double-walled construction that also includes an integral mounting arrangement which allows the internal combustion engine, generator and radiator of the generator set to be mounted directly to the tank without the need for a releasable frame assembly.

It is still another object of the invention to provide a generator set tank having the above features that is inexpensive to manufacture in conventional generator set construction techniques.

The present invention is a tank that is used with a generator set and includes an integral mounting arrangement and a double walled construction. The tank is formed with an outer member or basin having a lower wall, a pair of side walls, a front wall, and a rear wall. The outer member has an open top end and defines an interior between the side, front and rear walls accessible through the top end. An inner member is mounted within the interior of the outer member, and the inner and outer members cooperate to form a generator tank. The inner member includes a front panel, a pair of side panels, a rear panel, and a top panel. When the inner member is mounted within the outer member, the resulting generator tank has a double walled construction along the bottom, opposite sides, front and rear of the tank.

Once the inner member is mounted within the outer member, a number of support beams can be secured between the opposite sides of the outer member over the top panel of the inner member to provide an integral mounting arrangement for the radiator, generator and internal combustion engine components of the generator set.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
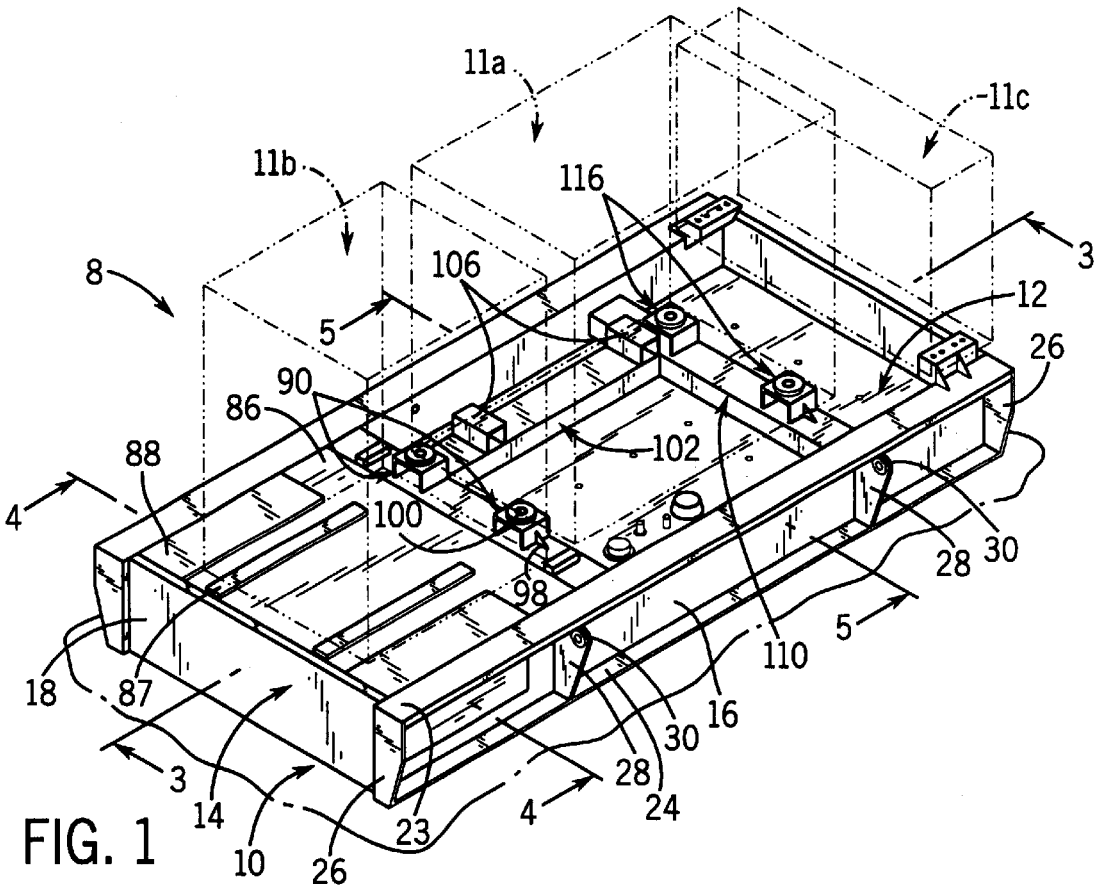
FIG. 1 is an isometric view of a generator set tank assembled according to the present invention.

With reference now to the drawing figures in which like reference numerals represent like parts throughout the disclosure, a generator set is shown in FIG. 1 generally at 8. The generator set 8 includes a tank 10 formed generally of metal components and an engine 11*a,* generator 11*b* and radiator 11*c* secured to the tank 10. The engine 11*a,* generator 11*b* and radiator 11*c* can be any conventional components used for supplying power from generator sets such as components made by Caterpillar, Inc. of Peoria, Ill. bearing Model Number 3412.

The tank 10 includes an inner member or enclosure 12 mounted within an outer member or basin 14. The basin 14 is formed with a bottom wall 15 that connects a pair of opposed side walls 16, and a front wall 18 and a rear wall 19 that, in turn, connect adjacent ends of the side walls 16. The basin 14 also includes a venting channel wall 20 spaced inwardly from the rear wall 19 and extending across the bottom wall between the side walls 16 that defines a venting channel 21 between the rear wall 19 and channel wall 20. The structure of the respective walls of the basin 14 defines an open interior 22 within the basin 14.

Figure 4:
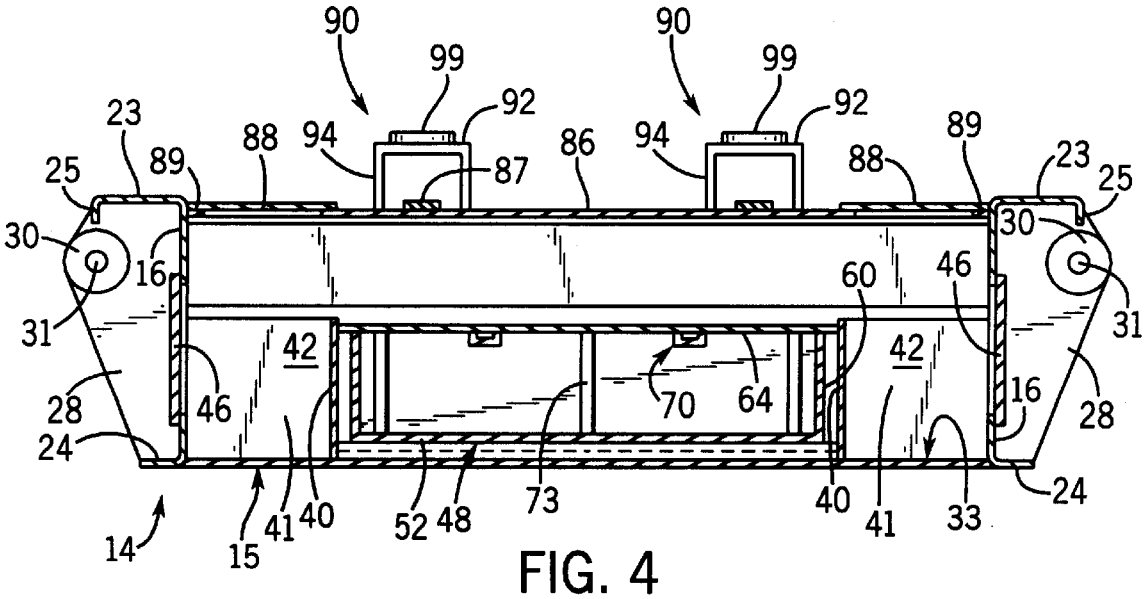
FIG. 4 is a cross-sectional view along line 4—4 of FIG. 1.
Figure 2:
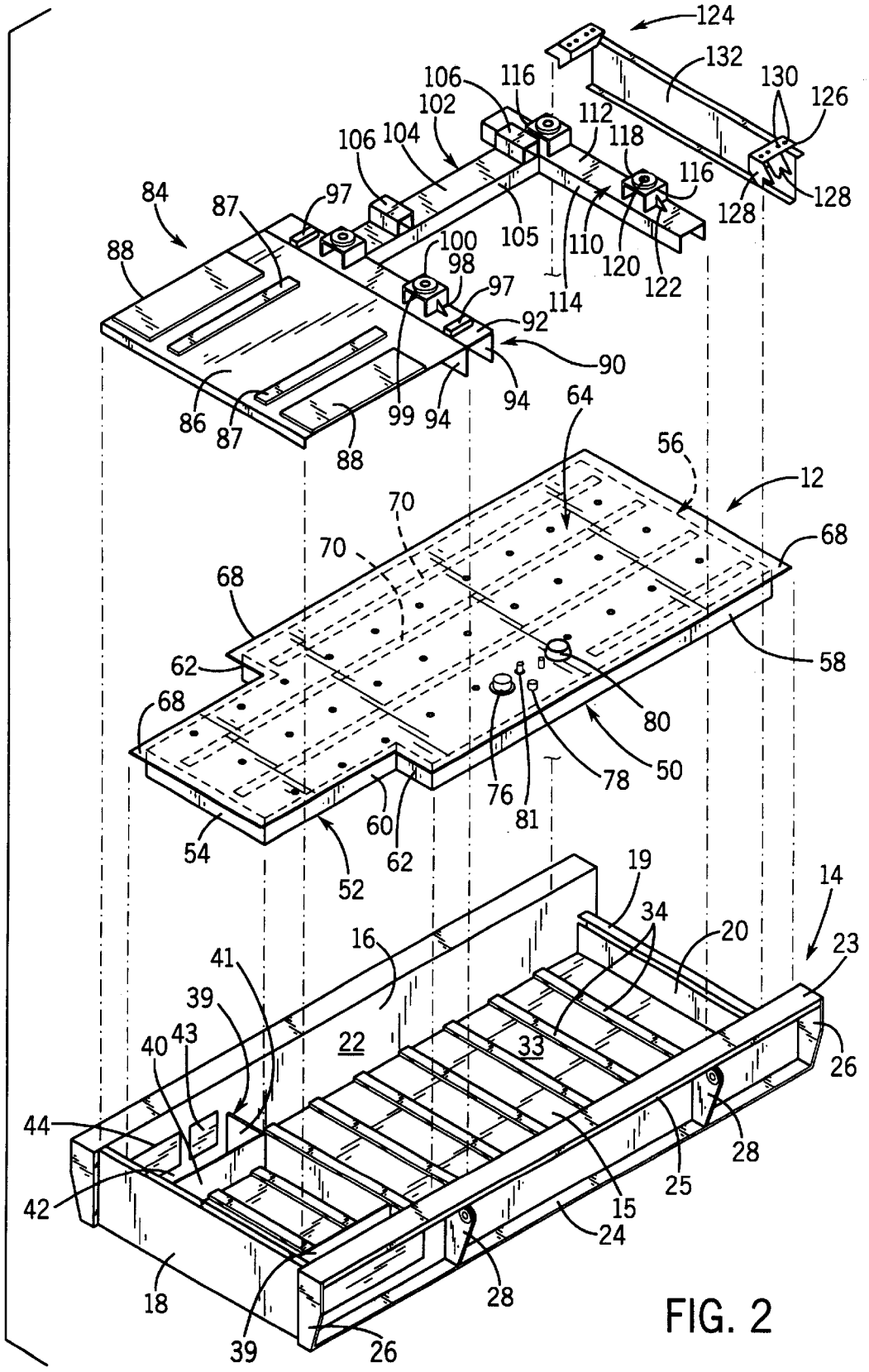
FIG. 2 is an exploded isometric view of the generator set tank of FIG. 1.
Figure 3:
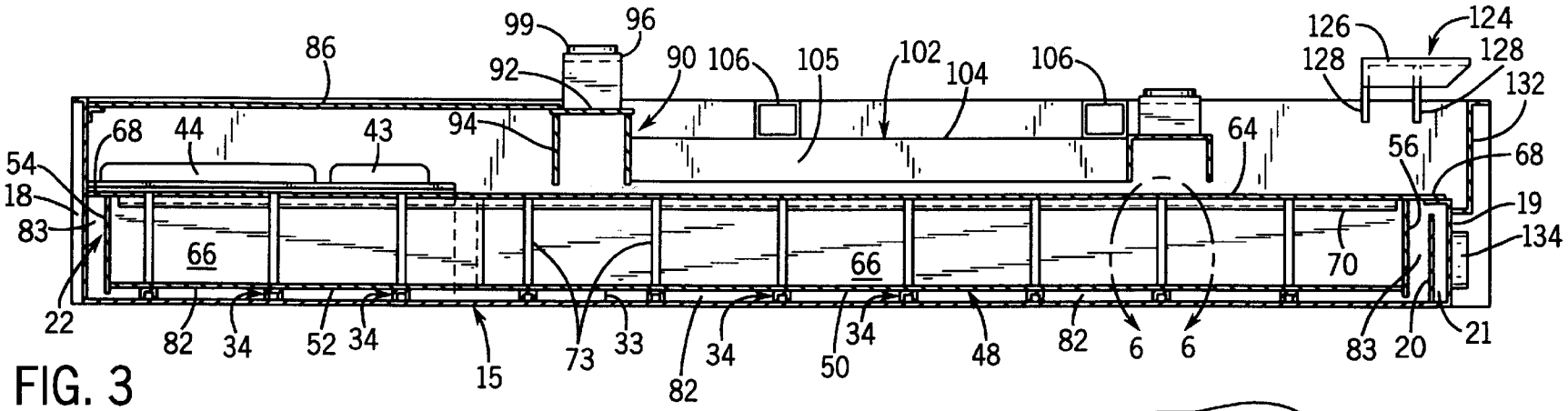
FIG. 3 is a cross-sectional view along line 3—3 of FIG. 1.
Figure 6:
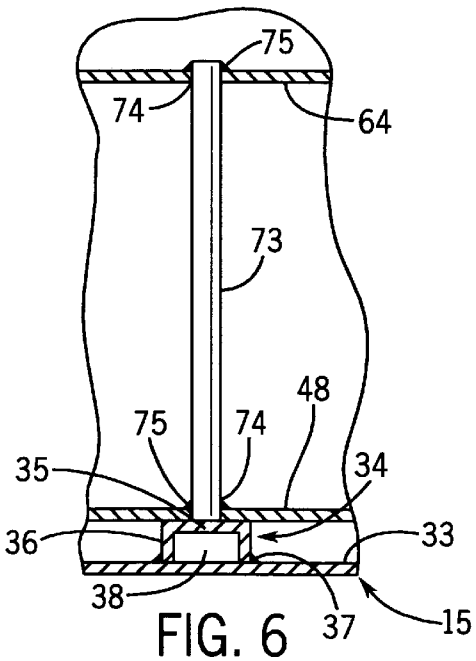
FIG. 6 is a circular sectional view along line 6—6 of FIG. 3.
Figure 5:
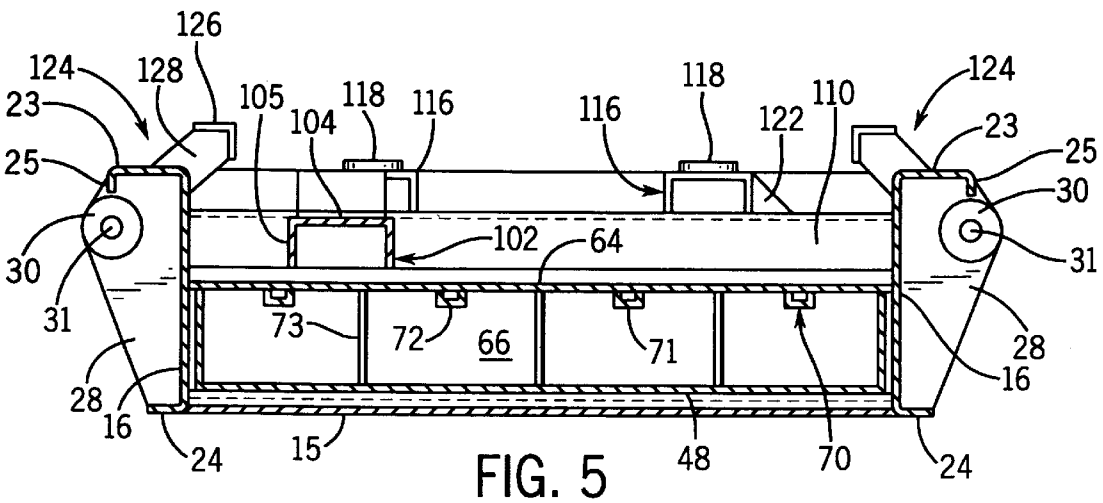
FIG. 5 is a cross-sectional view along line 5—5 of FIG. 1.

Referring now to FIGS. 2–4, each side wall 16 includes a perpendicularly extending upper flange 23 and a perpendicularly extending lower flange 24 that extend outwardly away from the interior 22. The upper flange 23 includes a downwardly depending lip 25 along its length and is joined to the lower flange 24 by a pair of end plates 26 disposed at either end of side walls 16. Each side wall 16 also includes a pair of lifting eye gussets 28 spaced from one another and from the end plates 26. Each gusset 28 includes a lifting eye 30 that defines a circular opening 32 through which a shackle (not shown) or other lifting implement may be inserted to lift and move the tank 10.

The bottom wall 15 of the outer basin 14 has a number of tank feet 34 along an upper surface 33 of the bottom wall 15. Each foot 34 is generally an inverted U-shape with a base 35 and a pair of legs 36 extending from opposite sides of the base 35. Each leg 36 is secured to the upper surface 33 of the bottom wall 15 opposite the base 35 by welds 37 to define channels 38 between the feet 34 and the bottom wall 15.

Adjacent the front wall 18, the bottom wall 15 also supports a pair of stub-up walls 39. The stub-up walls 39 are generally L-shaped having a first section 40 extending from the front wall 18 in a direction parallel to the side walls 16, and a second section 41 extending perpendicularly from the first section 40 opposite the front wall 18. Each second section 41 is connected with the adjacent side wall 16 and cooperates with the corresponding first section 40 to enclose a chamber 42. The chamber 42 is accessible through a pair of stub openings 43 and 44 in each side wall 16. The respective stub openings 43 and 44 allow for conduit connections (not shown) to be made through the side wall 16 of the tank 10 to other components of the generator set which are mounted above the basin 14. The openings 43 and 44 can selectively be covered by removable plates 46 securable to the side walls 16 after the necessary connections are made.

As best shown in FIGS. 2–6, the inner member 12 is insertable within the interior 22 of the basin 14. Inner member 12 has a bottom panel 48 that includes a main section 50 that conforms generally to the width between the side walls 16 of the basin 14. The bottom panel 48 also includes a narrow section 52 extending from the main section 50 towards the front wall 18 of the basin 14 that corresponds in width to the distance between the first sections 40 of the stub-up walls 39. The inner member 12 also includes a front panel 54 extending upwardly from the narrow section 52 opposite the main section 50 and a rear panel 56 extending upwardly from the main section 50 opposite the front panel 54. The front panel 54 and rear panel 56 are spaced from the front wall 18 and venting channel wall 20, respectively. The inner member 12 further includes a pair of long side panels 58 extending along the main section 50 from opposite ends of the rear panel 56 and a pair of short side panels 60 extending from opposite ends of the front panel 54 along the narrow section 52. The long panels 58 and short panels 60 are joined by a pair of shoulder panels 62 extending along the main section 50 between the long and short side panels 58, 60, respectively. Each shoulder panel 62 has a length slightly greater than that of the second section 41 of each stub-up wall 39. A top panel 64 secured to the respective side panels opposite the bottom panel 48 encloses an interior 66 within the inner member 12 and extends outwardly over each of the side, rear and front panels to define a flange 68 about the periphery of the inner member 12 opposite the bottom panel 48. The flange 68 is connected by welds to the front wall 18, stub-up walls 39, 40, side walls 16, and rear wall 19 of the basin 14 to secure the inner member 12 within the basin 14 when the inner member 12 is placed in the interior 22 of the basin 14.

Referring now to FIGS. 3–6, the interior 66 of the inner member 12 includes a number of supporting or bracing features. First, a number of stiffeners 70 extend along the length of the top panel 64 parallel to the long side panels 58 to provide support for the top panel 64. Stiffeners 70 extend throughout nearly the entire length of interior 66, such that the ends of stiffeners 70 are located closely adjacent front and rear panels 54, 56 respectively. Each stiffener 70 is shaped similarly to the tank feet 34, with a base 71 and a pair of legs 72 on opposite sides of the base 71, and is secured to the top panel 64 by each leg 72. The inner member 12 also includes a number of tie rods 73 extending vertically between the bottom panel 48 and the top panel 64. The tie rods 73 are located between stiffeners 70, and extend through openings 74 in the bottom panel 48 and top panel 64 and are secured therein by welds 75. Both the tie rods 73 and the stiffeners 70 provide additional rigidity to the inner member 12 to reduce the likelihood of leakage of fuel from the tank 10 due to damage done to the tank 10 and to enable the engine 11*a*, generator 11*b* and radiator 11*c* to be supported over the inner member 12.

The top panel 64 also includes a number of openings which allow fuel to be placed within and withdrawn from the interior 66 of inner member 12. As shown in FIG. 2, the top plate 64 includes a fuel filling coupling 76 to allow the inner member 12 to receive fuel, a fuel supply coupling 78 for withdrawing fuel from within the inner member 12, a vent 80 for releasing gas trapped in the inner member 12, and a fuel level gauge 82 for measuring the fuel remaining within the inner member 12.

When the inner member 12 is positioned within the basin 14, the rods 73 are aligned with the feet 34 disposed on the bottom wall 15 of the basin 14. Because each rod 73 extends through the opening 74 in the bottom panel 48, the rods 73 engage and are supported by the base 35 of each foot 34 to provide additional support to the rods 73 and the inner member 12. Furthermore, when the inner member 12 is positioned within the basin 14, the engagement of the feet 34 with the rods 73 cooperates to define a plurality of spaces 82 between the bottom panel 48 of the inner member 12 and the bottom wall 15 of the basin 14. Similarly, once the inner member 12 rests upon the feet 34 within the basin 14, a pair of spaces 83 are also defined between the front panel 54 of inner member 12 and the front wall 18 of basin 14, and the rear panel 56 of inner member 12 and the rear wall 19 of the basin 14. The location of the respective spaces 82 and 83 between the inner member 12 and the basin 14 provides the tank 10 with the capacity to sustain damage to the basin 14 without damaging the inner member 12. Further, the spaces 82 and 83 enable the tank 10 to prevent any fuel leaking from the inner member 12 into the basin 14 from leaking into the outside environment.

As best shown in FIGS. 2 and 3, once the inner member 12 is secured within the basin 14, a mounting arrangement 84 may be attached to the basin 14 above the inner member 12. The mounting arrangement 84 includes an access plate 86 that is connected to the front wall 18 and between the side walls 16 of the basin 14 to overlie the chambers 42 defined by the stub-up walls 39. The access plate 86 has a pair of rails 87 that extend parallel to the side walls 16 and are used to support the generator 11*b* placed on the plate 86. A pair of access panels 88 are also located on the top of the plate 86 outside of the rails 87. Each of the panels 88 include a resilient pad 89 at one end of the panel 88 that resiliently supports the panel 88 above the plate 96. This enables the panels 88 to be removed to allow access to the chambers 42 within the stub-up walls 39.

Opposite the front wall 18, the access plate 86 is connected to a generator support beam 90. The support beam 90 is generally an inverted U-shape and includes a top section 92 that includes an opening (not shown) and a pair of downwardly depending side sections 94. Each side section 94 and the top section 92 is connected to each side wall 16, such as by welding, to secure the generator support beam 90 within the basin 14. Opposite the side sections 94, the top section 92 includes a pair of generator mounts 96 and a pair of manual pump support brackets 97 disposed outside of the mounts 96 and welded to the top section 92. The mounts 96 are secured directly to the beam 90 over the openings in the beam 90 and are reinforced by triangular support gussets 98 extending between the mounts 96 and the top section 92 of the beam 90. Each generator mount 96 is generally an inverted U-shape, similarly to the generator support beam 90, and supports a circular mounting pad 99 above the generator support beam 90. Each mounting pad 99 includes a central opening 100 aligned with the opening in the beam 90. A bolt (not shown) extending from the generator 11*b* can be inserted through and secured within the respective openings to retain the generator 11*b* on the beam 90.

The mounting arrangement 84 also includes a battery cross support 102 that extends perpendicularly from the support beam 90 opposite the access plate 96. The support 102 is generally an inverted U-shape, similar to the generator support beam 90, with a base 104 and a pair of legs 105 extending from opposite sides of the base 104. The cross support 102 includes a pair of battery supports 106 that extend upwardly from the cross support 102. The battery supports 106 are arranged such that batteries (not shown) connected to the engine 11*a* rest on the battery supports 104.

Opposite the generator support beam 90, the battery cross support 102 is connected to an engine support beam 110 as shown in FIG. 3. The engine support beam 110 is formed similarly to the generator support beam 90 and includes a top section 112 and a pair of downwardly depending side sections 114 secured to the respective side walls 16. The side sections 114 have a length shorter than that of side sections 94 on the generator support beam 90 such that the engine support beam 110 has an overall height less than that of the generator support beam 90. The top section 112 of the engine support beam 110 supports a pair of engine mounts 116 that are formed identically to generator mounts 96, including openings 117, support pads 118 with corresponding central openings 120, and support gussets 122 secured between the mounts 116 and the beam 110.

The mounting arrangement 84 also includes a pair of radiator support members 124 that are secured to the side walls 16 adjacent the rear wall 19. Each radiator support member 124 includes an L-shaped support pad 126 and a pair of support gussets 128 extending angularly from the support pads 126 to the side walls 16. The support pads 126 include a plurality of openings 130 that are used to attach the radiator 11*c* between the support pads 126 over the inner member 12.

Finally, opposite the access plate 86 and beneath the radiator 11*c*, the interior of the basin 14 is enclosed by an end panel 132 extending upwardly from the rear wall 19 and connected between the side wall 16 and rear wall 19. The end panel 132 does not close off the channel 21 between the rear wall 19 and the venting channel wall 20, such that any gas trapped between the inner member 12 and the basin 14 can escape through a vent 134 secured to the rear wall 19 in communication with the channel 21.

The tank 10 can also be manufactured in various sizes to conform to the respective sizes of the generators, engines and radiators that are to be utilized with the tank 10. Further, the configuration of the tank 10 can also be altered when necessary to fit a specific application for which the tank 10 is to be used. More specifically, depending upon the size of the engine, generator and/or radiator with which the tank 10 is to be used, the tank 10 can be modified to remove or include additional feet 34, rods 73 and stiffeners 70 as necessary.

The tank 10 could also be modified by attaching the inner member 12 to the basin 14, or attaching the mounting arrangement 84 to the inner member 12 and basin 14 by means other than welds, such as rivets, industrial strength adhesives, or other suitable means. With these alternative means for securing the respective components of tank to one another, alternative methods of forming the tank 10 are also contemplated. For example, individual sections of the inner member 12 can be secured to the adjacent portions of the basin 14 before attachment to form the basin 14 or inner member 12 in order to form a tank 10 that can be assembled from prefabricated sections.

Also, the mounting arrangement 84 can have a variety of configurations other than that shown in the drawing figures, such as an arrangement connected only to the inner member 12 and supported thereon, or a flat panel completely covering the interior 22 of the basin 14 without any connection to the inner member 12. This panel could be supported by the extension of the rods 73 through the top panel 64 of the inner member 12 such that the rods 73 contact the lower surface of the panel to support the weight of the generator, engine and radiator placed thereon.

Various alternatives and embodiments are contemplated as being in the scope of the following claims particularly pointing out and distinctly claiming the subject matter regarded as the invention.

I claim:

1. A double-walled tank for a generator set including a generator, an engine and a radiator, the tank comprising:

an outer member for supporting the generator set on a surface, the outer member being a generally enclosed structure having a bottom wall, a plurality of side walls and an open top end, and defining an interior;

an inner member mounted to the outer member within the interior of the outer member, the inner member being an enclosed structure generally conforming to the shape of the interior of the outer member and having a bottom panel, a top panel and a plurality of side panels; and a mounting structure secured to at least one of the inner member and the outer member and adapted to receive at least one of the generator, engine and radiator.

2. The tank of claim 1 wherein the inner member has a main section and a narrow section extending from one end of the main section.

3. The tank of claim 2 wherein the narrow section defines a pair of chambers between the outer member and the narrow section.

4. The tank of claim 3 wherein the outer member includes at least one opening allowing access to each chamber.

5. The tank of claim 2 wherein the outer member includes a pair of intermediate walls connected to the side walls at opposite ends and conforming in shape to the narrow section.

6. The tank of claim 1 wherein the outer member includes a number of supports disposed on the bottom wall that support the inner member above the bottom wall.

7. The tank of claim 1 wherein the inner member includes a number of spaced horizontal reinforcement members disposed on the top panel within the inner member.

8. The tank of claim 7 wherein the inner member includes a number of spaced vertical reinforcement members extending between the top panel and the bottom panel.

9. The tank of claim 1 wherein the inner member includes a number of spaced vertical reinforcement members extending between the top panel and the bottom panel.

10. The tank of claim 9 wherein the vertical members extend at least partially through openings in the top panel.

11. The tank of claim 10 wherein the vertical members are secured within the openings by welds.

12. The tank of claim 9 wherein the vertical members extend at least partially through openings in the bottom panel.

13. The tank of claim 12 wherein the vertical members are secured within the openings by welds.

14. The tank of claim 1 wherein the top panel includes a peripheral flange used to secure the inner member to the outer member and define a space therebetween.

15. A generator set comprising:

a tank having a basin with an open end, the basin defining an interior space, an enclosed inner member mounted within the interior space of the basin and a mounting arrangement overlying the inner member;

a generator mounted to the mounting arrangement;

an engine mounted to the mounting arrangement and operably connected to the engine; and a radiator mounted to the mounting arrangement and operably connected to the engine.

16. The generator set of claim 15 wherein the outer member includes a bottom wall and a number of supports disposed on the bottom wall that support the inner member above the bottom wall.

17. The generator set of claim 15 wherein the mounting arrangement is secured to the basin over the inner member.

18. The generator set of claim 15 wherein the mounting arrangement includes a generator support beam extending across the basin over the inner member and supporting the generator.

19. The generator set of claim 18 wherein the mounting arrangement includes an access plate connected to the generator support beam and overlying a portion of the inner member within the basin.

20. The generator set of claim 18 wherein the mounting arrangement includes an engine support beam extending across the basin over the inner member spaced from the generator support beam and supporting the generator.

21. The generator set of claim 20 wherein the mounting arrangement includes a cross beam connecting the generator support beam and the engine support beam.

22. The generator set of claim 15 wherein the mounting arrangement includes at least one radiator support bracket secured to the basin and used to support the radiator.

23. The generator set of claim 15 wherein the mounting arrangement is secured to the basin and to the inner member.

24. A method for forming an integral mounting, dual-walled tank for a generator set, the method comprising the steps of:

a) providing a basin, including a bottom wall, a number of side walls connected to the bottom wall and an open top, and a basin defining an interior;

b) providing an enclosure having a bottom panel, a top panel and a number of side panels connecting the top and bottom panels to define an enclosed volume within the enclosure;

c) providing a mounting arrangement adapted to mountably receive a generator, an engine connectable to the generator and a radiator connectable to the engine;

d) securing the enclosure within the interior of the basin; and e) securing the mounting arrangement within the interior of the basin over the enclosure.

25. A combined fuel tank and support for a generator set including an engine, a generator and a radiator, comprising:

a shell including a first bottom wall and one or more upwardly extending first side walls which cooperate to define a cavity;

a tank located within the cavity and defining an enclosed volume adapted to receive a quantity of fuel wherein the tank includes a second bottom wall, one or more upwardly extending second side walls and a top wall, wherein the second bottom wall is spaced inwardly from the first bottom wall and the one or more second side walls are spaced inwardly from the one or more first side walls; and support structure interconnected with the shell and overlying the tank, wherein the support structure is adapted to support one or more of the engine, the generator and the radiator.

* * * * *